United States Patent [19]

Kaunisvesi

[11] Patent Number: 4,735,175

[45] Date of Patent: Apr. 5, 1988

[54] METHOD OF CLEANING THE HEAT TRANSMISSION SURFACES OF A STEAM BOILER OR THE LIKE

[75] Inventor: Lauri Kaunisvesi, Tampere, Finland

[73] Assignee: Oy Tampella Ab, Finland

[21] Appl. No.: 29,901

[22] Filed: Mar. 25, 1987

[30] Foreign Application Priority Data

May 2, 1986 [FI] Finland ..... 861850

[51] Int. Cl.[4] ..... F22B 37/54

[52] U.S. Cl. ..... 122/390; 15/316 R; 110/204

[58] Field of Search ..... 122/379, 390, 392, 405; 110/203, 204, 216, 233, 234, 235, 341, 344, 345; 165/95; 15/316 R, 301, 104.04; 134/166 R, 166 C, 198

[56] References Cited

U.S. PATENT DOCUMENTS 776,479 11/1904 Mettler ..... 122/379 X
4,182,274 1/1980 Williams ..... 110/204 X
4,333,742 6/1982 Tanca ..... 15/316 R X
4,583,496 4/1986 Albers et al. ..... 122/390 X

FOREIGN PATENT DOCUMENTS 136911 8/1983 Japan ..... 110/216

*Primary Examiner*—Steven E. Warner
*Attorney, Agent, or Firm*—Banner, Birch, McKie & Beckett

[57] ABSTRACT

The invention relates to a method of cleaning the heat transmission surfaces of a steam boiler or the like. In the method the deposits which are formed on the heat transmission sufaces of the superheater of the boiler and the other heat transmission surfaces thereof during the operation and which hamper the heat transmission are removed by directing a cleaning jet of medium to said surfaces through sweepers. In order to provide a reliable, simple and energy saving cleaning method, the flue gases of the boiler are used as a medium. The flue gases can be taken from a gas flue positioned after an electric filter.

5 Claims, 1 Drawing Sheet

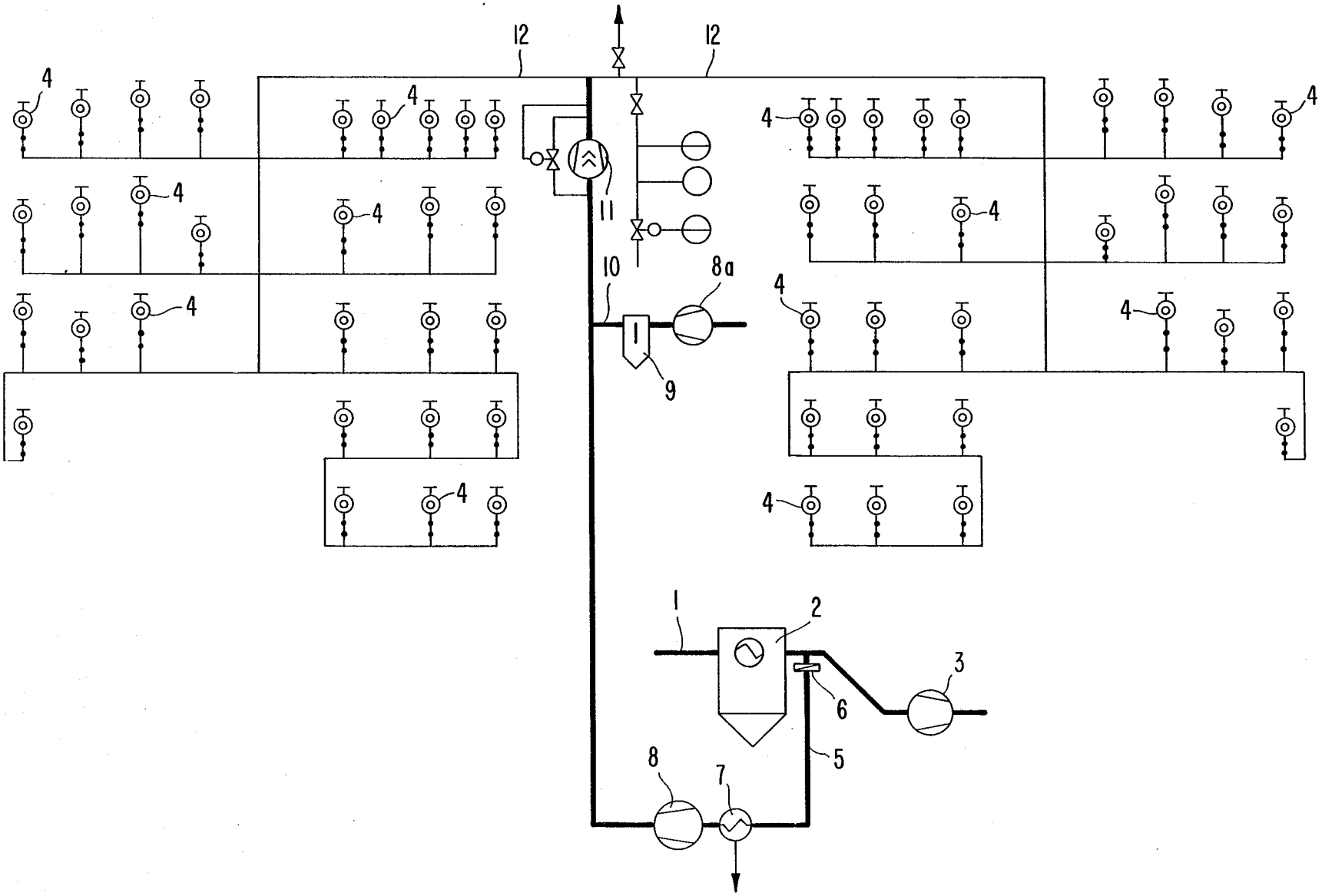
1
2
3
4
5
6
7
8
8a
9
10
11
12

METHOD OF CLEANING THE HEAT TRANSMISSION SURFACES OF A STEAM BOILER OR THE LIKE

The invention relates to a method of cleaning the heat transmission surfaces of a steam boiler or the like, in which method the deposits which are formed on the heat transmission surfaces of the superheater of the boiler and the other heat transmission surfaces thereof during the operation and which hamper the heat transmission are removed by directing a cleaning jet of medium to said surfaces through sweepers said medium being the flue gases of the boiler.

This kind of cleaning methods are generally known in power station techniques. In prior methods the sweeping medium, i.e. steam, is passed along a pipe system to sweepers positioned on both walls of the boiler in a horizontal position with respect to the side wall of the boiler. The sweepers are e.g. long telescope-type sweeping means provided with discharge nozzle pieces, rake sweepers and stationarily positioned rotating sweeping means. Long telescope-type sweeping means are intended for the cleaning of the area of the superheater, rake sweepers for the cleaning of the area of the preheater of the feed water, and rotating sweeping means for the cleaning of the lamella area of the flue gas side of the preheater of air.

The sweeping order is the same as the direction of the flue gas flow and always alternant, i.e. a pair of sweepers always operates in an alternating manner. A subsequent sweeper is started when a preceding one is in the termination position and stopped.

A disadvantage of these prior sweeping methods is that disturbances occur in the draught adjustment of the furnace at the sweeping stage. The increase of the load of the flue gas blowers is also a major disadvantage, because the mass flow rate of the sweeping steam fed into the boiler, which rate exceeds 2.5 kg/s, respectively increases the proportional amount of moist flue gases. Of course, a further disadvantage is that the steam used for the sweeping decreases the energy productions of the boiler with a corresponding amount. Still an another disadvantage is that water may get into the furnace, which results in a risk of explosion in the soda recovery boiler. One disadvantage of known systems is also the complicated structure which increases the manufacturing and maintaining costs.

The object of the invention is to provide a method for cleaning the heat transmission surfaces of a steam boiler or the like, which method avoids the disadvantages of prior methods. This is achieved by means of a method according to the invention, which is characterized in that the flue gases of the boiler are used as a medium.

An advantage of the method according to the invention is, for instance, that the ratio of the pressure of the flue gas to the temperature thereof can be adjusted to the right value within a very wide range, also according to the requirements of the sweeping process so that the kind of the deposit etc. can be taken into consideration. The disturbances in the draught adjustment of the furnace are eliminated, because one and the same mass flow of flue gases circulates in the boiler and functions as a medium in the sweeping. The load of the flue gas blowers is decreased, because the proportional amount of moist flue gases is reduced with the amount of the sweeping steam, i.e. more than 2.5 kg/s. The method according to the invention also provides an improved sweeping efficiency as compared with prior systems. This is due to the fact that the best possible solution can be sought with respect to the temperature, pressure and the number of sweepers. By means of the method according to the invention the sweepers can be controlled in a very simple manner, because it is possible to operate several sweepers at the same time by virtue of the closed mass flow of the medium.

Still another advantage is that the sweeping steam valves, safety valves, pressure reduction valves and watering valves as well as the controls thereof are omitted, because the whole sweeping steam system becomes unnecessary. In the method according to the invention, the high-pressure sweeping piping is simple and very short. This is because it has been necessary to dimension the structures of prior sweeping systems so that they resist a sweeping steam pressure of 60 to 100 bar, which has increased the price of the apparatus. In the solution according to the invention, an apparatus having a pressure resistance of the order of 20 bar can be used, so that the apparatus can be simpler than previously, and considerably more inexpensive components than previously can be used. The quarantee value of the amount of sweeping steam is eliminated, and electrical power as well as bled steam energy and back pressure steam energy is produced from the steam previously used for the sweeping. Since the sweeping steam system is eliminated, water cannot any longer get into the furnace, which is a major advantage in connection with soda recovery boilers. The invention is also advantageous in that the position of the sweepers with respect to the side wall of the boiler can be chosen freely, so that the sweeping efficiency is improved as compared with prior systems. In the prior solutions, the position of the sweepers is restricted, because the sweepers have to be mounted according to the wall structure of a boiler designed in advance so that the condensation water formed during the sweeping would not get to the bottom of the boiler and, for example, cause an explosion in a soda recovery boiler. In the solution according to the invention, in which the sweeping does not utilize steam, no condensation water is formed, either, and the positions and locations of the sweepers can be such that the sweeping will be carried out as efficiently as possible, because the risk of the condensation water flowing down does not need to be taken into consideration.

The invention will be described in the following in more detail by means of one preferred embodiment shown in the attached drawing, whereby the FIG. of the drawing is a schematical view of a sweeping system utilizing the method according to the invention.

In the example of the FIG., which example is only one embodiment of the invention, a gas flue from a steam boiler (not shown in the FIG.) is indicated by the reference numeral 1. An electric filter 2 is attached to the gas flue 1. A flue gas blower 3 is arranged in the gas flue after the electric filter 2. These matters belong to the prior art, so they are not more closely discussed in this connection.

During the use of the boiler, deposits of impurities are formed on superheater surfaces and other such heat transmission surfaces. Such deposits hamper the heat transmission and cause the gas flues to be blocked. These deposits of impurities are removed by means of sweepers 4 which direct a cleaning jet of medium on the surfaces.

In the method according to the invention the flue gases of the boiler are used as a medium. The flue gases are thereby preferably obtained by means of a channel 5 branching from a gas flue positioned after the electric filter 2. The channel 5 is thereby provided with a suitable closing means, such as a manually operated closing plate 6.

Seen in the direction of flow, the channel 5 is further provided with a flue gas cooler and dryer which is indicated by the reference numeral 7 in the FIG. After the cooler-dryer 7, the flue gases pass through a high-pressure blower 8 to a point where a hot air channel 10 coming from the boiler and provided with a hot gas compressor 8a and a dust remover 9 joins the channel 5.

The channel 5 extends up to a compressor 11 the delivery side of which comprises a high-pressure piping 12 provided with conventional constant-pressure valves and safety valves. The sweepers 4 are attached to the high-pressure piping, and the cleaning flow of flue gases is led onto the dirty heat transmission surfaces through the sweepers 4.

The system according to the FIG. may further comprise a neutralizing aggregate by means of which a flue gas can be neutralized, if its pH is too low. This neutralizing aggregate is not shown in the FIG., but it can be attached to the beginning of the channel 5, for instance. This is not the only possible location of the aggregate, but it can be positioned as desired; however, before the proper sweeper. It is also possible to feed through the neutralizing aggregate or the like some other material in place of the neutralizing agent, such as lime in connection with desulphuration, so that this material can be extremely efficiently mixed with the flue gas flow.

The sweepers 4 used in a system utilizing the invention may be similar to sweepers used previously in systems utilizing steam.

The system according to the FIG. operates in principle the following way. The inlet end of the channel 5 is opened by means of the hand closing plate 6 so that flue gas is able to flow through the cooler-dryer 7 to the high pressure, which forces the flue gas onwards to the connection point of the channel 5 and the hot air channel 10, at which point the temperature of the flue gas is adjusted to a desired value. The kind of the deposit to be removed and other such matters can thereby be taken into consideration in the temperature adjustment. The above-mentioned location of the cooler-dryer is not the only possible; instead, the device may be positioned on the delivery side of the high pressure, if necessary. Naturally, the cooling air of the cooler-dryer can also be utilized in a desired manner.

Thereafter the flue gases flowing in the channel 5 are passed into the compressor 11, which forces them into the sweepers 4 through the high-pressure piping 12. The sweepers 4 are controlled by means of a suitable programme so that a control simpler than previously can be used, because several sweepers can be operated simultaneously by virtue of the closed medium flow according to the invention.

The embodiment described above is not intended to restrict the invention in any way, but the invention can be modified within the scope of the claims as desired. Accordingly, it is obvious that the system utilizing the invention does not need to be exactly similar to that shown in the FIG., but other kind of solutions are possible as well. The flue gas used for sweeping does not have to be provided from the gas flue positioned after the electric filter, as in the FIG., but a solution of some other type is equally possible. In view of the efficiency of the boiler, it is, however, of advantage that the flue gases for sweeping are taken from a gas flue positioned after the heat transmission surfaces of the boiler. If the efficiency of the boiler does not necessarily have to be the best possible, it is, however, possible to take the flue gases from the gas flue e.g. at a point which is before the last heat exchanger in the direction of flow, etc. The neutralizing of the flue gas can be carried out at any suitable place. The method according to the invention is not, either, restricted to steam boilers, but the method can also be utilized in other kind of the processes and apparatuses.

What is claimed is:

1. A method of cleaning the heat transmission surfaces of a steam boiler or the like, in which the deposits which are formed on the heat transmission surfaces of the superheater of the boiler and on the other heat transmission surfaces thereof during operation which hamper heat transmission are removed, said method comprising: directing a cleaning jet of boiler flue gases to the surfaces through sweepers, wherein the pressure-temperature ratio of the flue gases is adjustable over a wide range and according to various sweeping requirements by hot gases from a boiler passed through a hot gas compressor to improve the sweeping efficiency and eliminate disturbances in the draught adjustment of the furnace.

2. A cleaning method according to claim 1, wherein the flue gases are taken from a gas flue positioned after the heat transmission surfaces of the boiler.

3. A cleaning method according to claim 1, wherein the flue gases are taken from a gas flue positioned after an electric filter.

4. A cleaning method according to claim 1 wherein the flue gases are passed through a cooler-dryer before passing through a high pressure blower.

5. A cleaning method according to claim 4 wherein the properties of the flue gases are adjusted by the cooler-dryer.

* * * * *